US010294733B2

(12) United States Patent
Johnson

(10) Patent No.: US 10,294,733 B2
(45) Date of Patent: May 21, 2019

(54) LENGTH-ADJUSTABLE CONNECTOR FOR A DOWNHOLE TOOL

(71) Applicant: CANAMERA CORING INC., Edmonton (CA)

(72) Inventor: Orren Johnson, Edmonton (CA)

(73) Assignee: Canamera Coring Inc., Edmonton, Alberta (CA)

( * ) Notice: Subject to any disclaimer, the term of this patent is extended or adjusted under 35 U.S.C. 154(b) by 271 days.

(21) Appl. No.: 15/287,850

(22) Filed: Oct. 7, 2016

(65) Prior Publication Data

US 2017/0145759 A1 May 25, 2017

(30) Foreign Application Priority Data

Nov. 25, 2015 (CA) ..... 2913044

(51) Int. Cl.
*E21B 17/07* (2006.01)
*E21B 10/02* (2006.01)
*E21B 25/00* (2006.01)

(52) U.S. Cl.
CPC ..... *E21B 17/076* (2013.01); *E21B 10/02* (2013.01); *E21B 25/00* (2013.01)

(58) Field of Classification Search
CPC ..... E21B 17/07; E21B 17/073; E21B 17/076
See application file for complete search history.

(56) References Cited

U.S. PATENT DOCUMENTS

2011/0284208 A1* 11/2011 MacLeod ..... E21B 17/07 166/88.2

OTHER PUBLICATIONS

"Drill Bits & Services" brochure, Halliburton, available at least as early as Mar. 24, 2015. [20 pages].

* cited by examiner

*Primary Examiner* — Catherine Loikith
(74) *Attorney, Agent, or Firm* — Davis & Bujold PLLC; Michael J. Bujold

(57) ABSTRACT

A length-adjustable connector for a downhole tool has an outer tubular body with an inner bore and a first locking profile accessible from the inner bore. A rotatable inner tubular body having a second locking profile is within the outer tubular body. The connector also has a threaded connection between the outer and- inner tubular bodies that causes axial movement of the inner tubular body relative to the outer tubular body as the inner tubular body rotates, and a locking sleeve having first and second ends sized to engage the first and second locking profiles respectively. The locking sleeve prevents relative rotation of the tubular bodies when engaged with the locking profiles. A connector is carried by the inner tubular body that extends axially away from the locking sleeve, and moves axially relative to the outer tubular body as the inner tubular body is rotated.

6 Claims, 6 Drawing Sheets

LENGTH-ADJUSTABLE CONNECTOR FOR A DOWNHOLE TOOL

TECHNICAL FIELD

This relates to a downhole tool with a length-adjustable connector, such as may be used for a coring tool.

BACKGROUND

When drilling, a coring tool may be used to obtain a core sample of the formation being drilled. This generally involves a coring bit that is open in the center, and a barrel behind the coring bit. The barrel receives and holds the core sample as it enters through the center of the coring bit.

Often, the barrel and the related components will be made from a different material than the coring bit and the drill string that drives the coring bit. As a result, differences in the coefficient of thermal expansion between materials can change the relative position of the coring bit and the barrel when exposed to different temperatures. While coring tools are generally designed to account for this, the temperature in any particular well may be different from the design.

SUMMARY

According to an aspect, there is provided a length-adjustable connector for a downhole tool, comprising an outer tubular body having a first end, a second end, an inner surface that defines an inner bore, and a first locking profile accessible from the inner bore, an inner tubular body rotatably disposed within the inner bore of the outer tubular body, the inner tubular body comprising an outer surface and an inner surface, the inner surface comprising a second locking profile, a threaded connection between the inner surface of the outer tubular body and the outer surface of the inner tubular body, the threaded connection causing axial movement of the inner tubular body relative to the outer tubular body as the inner tubular body rotates relative to the outer tubular body, a locking sleeve having a first end that is sized to removably engage the first locking profile and a second end that is sized to removably engage the second locking profile, the locking sleeve preventing relative rotation of the outer tubular body and the inner tubular body when engaged with the first and second locking profiles, and a connector carried by the inner tubular body that extends axially away from the locking sleeve, the connector moving axially relative to the outer tubular body as the inner tubular body is rotated relative to the outer tubular body.

According to another aspect, the outer tubular body may comprise threaded connections for connecting to a downhole drill string.

According to another aspect, the locking sleeve receiver may comprise one or more axially-extending slots that engage one or more first locking keys that extend outward from the first end of the locking sleeve.

According to another aspect, the first locking profile may comprise one more axially-extending slots and the one or more first locking keys may simultaneously engage the axially-extending slots of each of the first locking profile and the locking sleeve.

According to another aspect, the locking sleeve may comprise one or more second locking keys spaced that engage the second locking profile of the inner tubular body.

According to another aspect, the second locking profile may comprise an axially extending slot in the inner surface of the inner tubular body.

According to another aspect, the inner tubular body may move between a retracted position and an extended position relative to the outer tubular body as the inner tubular body is rotated relative to the outer tubular body.

According to another aspect, the connector may be sized to be received within the inner bore of the outer tubular body in at least the retracted position.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
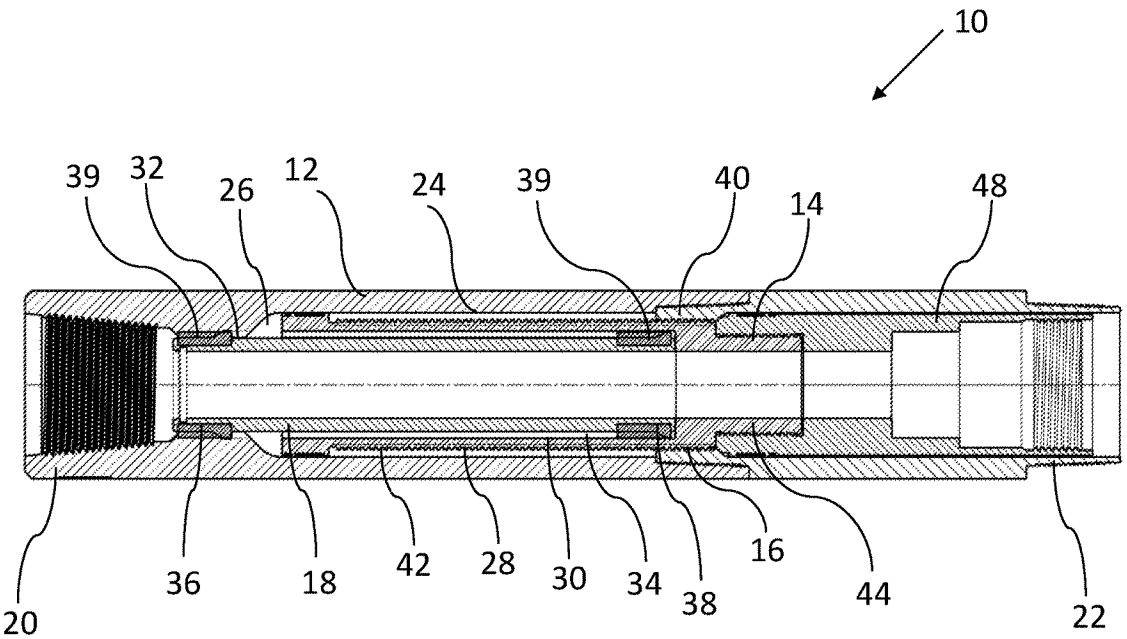
FIG. 1 is a side elevation cross-sectional view of a length-adjustable connector for a downhole tool in a retracted position.
Figure 2:
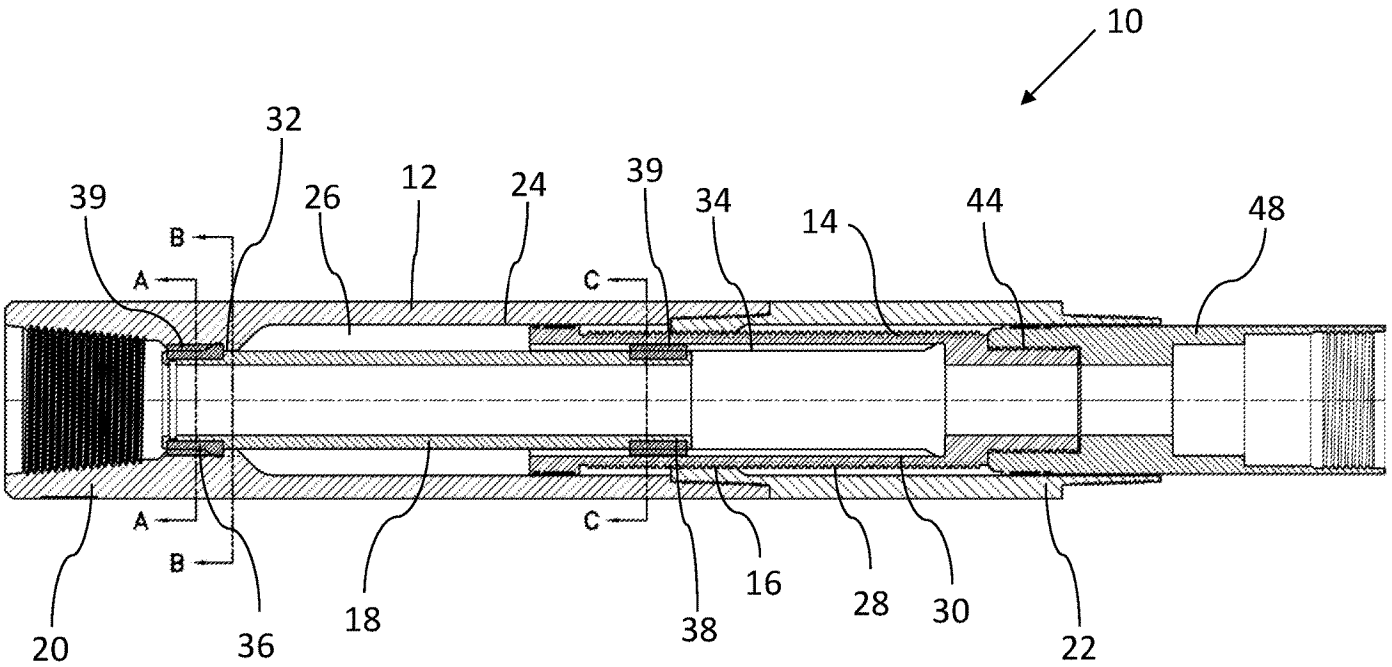
FIG. 2 is a side elevation cross-sectional view of the length-adjustable connector for a downhole tool of FIG. 1 in an intermediate position.
Figure 3:
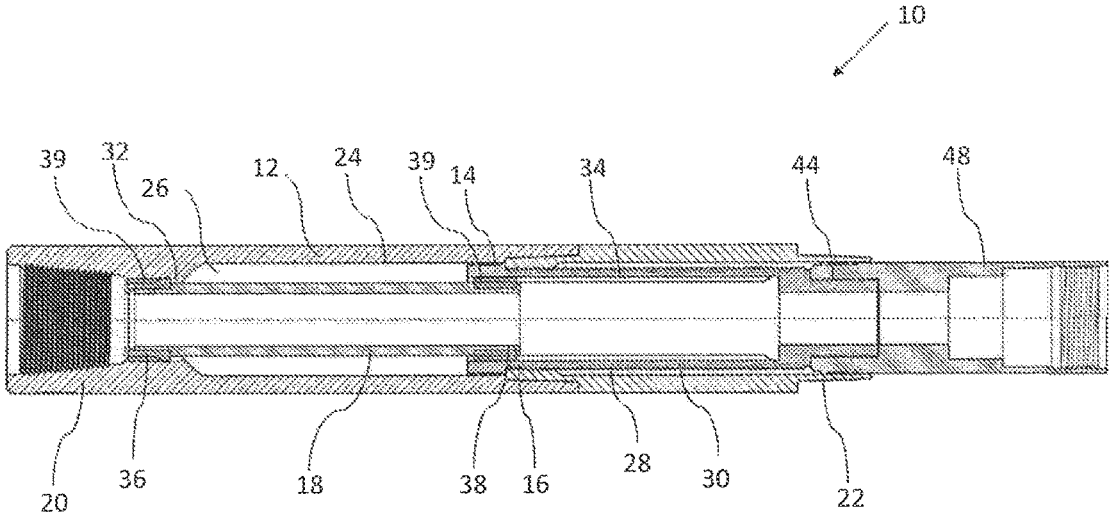
FIG. 3 is a side elevation cross-sectional view of the length-adjustable connector for a downhole tool of FIG. 1 in an extended position.
Figure 5:
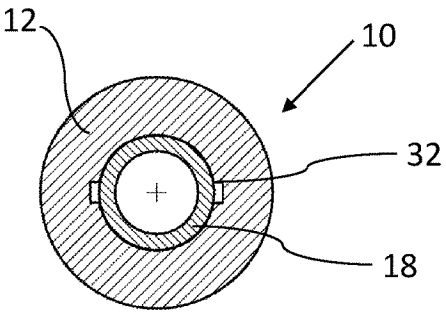
FIG. 5 is a top plan cross-sectional view of the length adjustable connector for a downhole tool of FIG. 2 along the line B-B.
Figure 6:
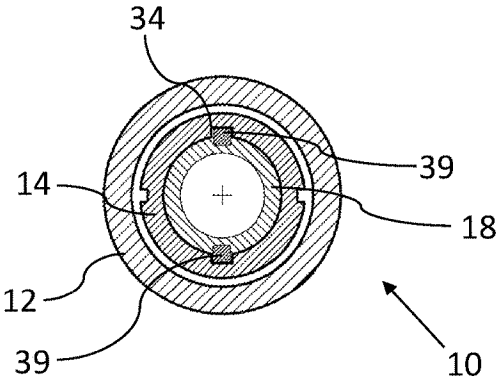
FIG. 6 is a top plan cross-sectional view of the length adjustable connector for a downhole tool of FIG. 2 along the line C-C.
Figure 4:
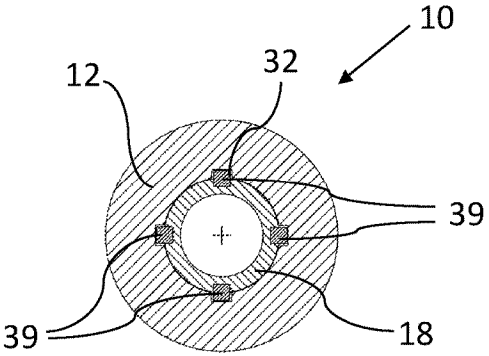
FIG. 4 is a top plan cross-sectional view of the length adjustable connector for a downhole tool of FIG. 2 along the line A-A.

A length-adjustable connector for a downhole tool, generally identified by reference numeral 10, will now be described with reference to FIG. 1 through 6.

Referring to FIG. 1, length-adjustable connector 10 has an outer tubular body 12, an inner tubular body 14 that is positioned within outer tubular body 12 and engages outer tubular body 12 by a threaded connection 16. A locking sleeve 18 is used to prevent relative rotation of outer tubular body 12 and inner tubular body 14. The depicted arrangement is intended to allow inner tubular body 14 to be rotated relative to outer tubular body 12 until a desired position is achieved, and then locked into place by installing locking sleeve 18.

In the depicted embodiment, outer tubular body 12 has a first end 20, a second end 22 and an inner surface 24 that defines an inner bore 26. In the depicted embodiment, outer tubular body 12 is designed as a sub and is threaded at either end such that it can be installed in a downhole string, such as a drill string. Inner tubular body 14 is rotatably disposed within inner bore 26 of outer tubular body 12 and has an outer surface 28 and an inner surface 30. There is a first locking profile 32 carried by outer tubular body 12 that is accessible from inner bore 26 and a second tubular locking profile 34 on inner surface 30 of inner tubular body 14. In the depicted embodiment, first and second locking profiles 32 and 34 are axially-extending slots on the inner surface of outer tubular body 12 and inner tubular body 14, respectively. As can be seen, first locking profile 32 is shorter in length than second locking profile 34 as outer tubular body 12 is considered to be stationary, while inner tubular body 14 is intended to move axially within outer tubular body 12, and a longer locking profile allows for a wider range of locations that can be used to secure inner tubular body 14.

As noted above, locking sleeve 18 is used to hold inner and outer tubular bodies 12 and 14 in relative rotational positions. As depicted, locking sleeve 18 is a tubular body with a first end 36 that is sized and shaped to removably engage first locking profile 32 and a second end 38 that is sized and shaped to removably engage second locking profile 34. When engaged with first and second locking profiles 32 and 34, locking sleeve 18 prevents relative rotation of outer tubular body 12 and inner tubular body 14. A shown, first and second ends 36 and 38 of locking sleeve 18 are fitted with keys 39 that engage the slots of first and second locking profiles 32 and 34. As keys 39 have a constant thickness, they are able to be slid along locking profiles 32 and 34 until the desired position is received. Also, as can be seen by comparing FIG. 4, FIG. 5, and FIG. 6, which are cross-sections taken at different positions along the length of length-adjustable connector 10, some of the slots in locking profile 32 extend the entire length of the shoulder in which they are formed, while others do not. This allows certain slots to act as a passageway for those keys 39 used to engage locking profile 34 of inner tubular body 14 to pass through locking profile 32, while other slots act as axial stops to ensure inner tubular body 14 is inserted to the desired position. It will be understood that the same result could also be achieved in other ways, such as by making second locking profile 34 a smaller diameter than first locking profile. It will also be understood that locking sleeve 18 and locking profiles 32 and 34 may have different shapes or may be manufactured in different ways while still allowing locking sleeve 18 to engage both inner and outer tubular bodies 12 and 14 and secure them against relative rotation. In addition, it will be understood that the relative length of locking profiles may be changed as long as the desired range of locked positions are permitted.

Figure 8:
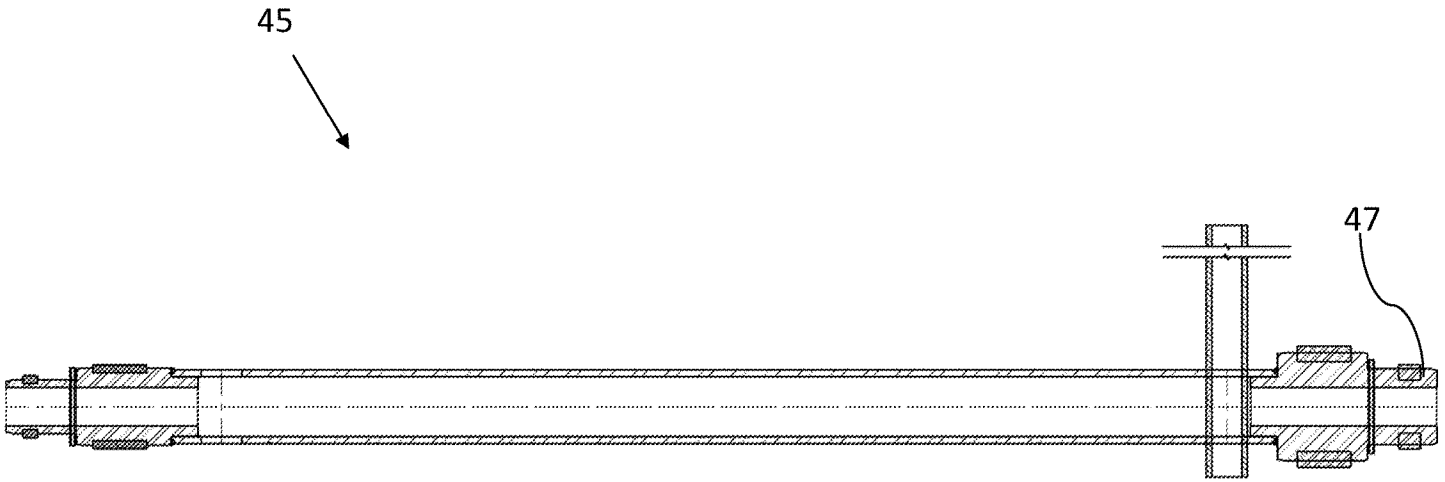
FIG. 8 is a side elevation cross-sectional view of a wrench for use with a length-adjustable connector for a downhole tool.

Outer tubular body 12 and inner tubular body 14 are connected and mounted together by threaded connection 16. Threaded connection 16 has a first set of threads 40 on inner surface 24 of outer tubular body 12 and a second, matching set of threads 42 on outer surface 28 of inner tubular body 14. When locking profiles 32 and 34 are not engaged, inner tubular body 14 is able to rotate relative to outer tubular body 12, such that threaded connection 16 causes inner tubular body 14 to move axially relative to outer tubular body 12 between a retracted and an extended position, as the case may be. By properly setting inner tubular body 14 within outer tubular body 12, length adjustable connector 10 may be set to provide a desired effective length for a tool (not shown) that may be attached to a connection point 44. Inner tubular body 14 may be rotated by any suitable wrench that engages inner tubular body 14 from either end. An example of a suitable wrench 45 is shown in FIG. 8, which is provided with two sizes at either end, which allows it to be used for different sizes of length-adjustable connectors 10, depending on the size of tubing that is being used. Wrench 45 is inserted such that it engages second locking profile 34 and then used to rotate inner tubular body 14. Once the desired length is achieved, wrench 45 is removed and locking sleeve 18 is inserted to engage both first and second profiles 32 and 34. In the depicted embodiment, care should be taken to ensure that first and second locking profiles 32 and 34 are properly aligned to ensure locking sleeve 18 is properly inserted. Wrench 45 also has a locking sleeve engagement end 47 that is sized to engage the inside surface of locking sleeve 18 in order to allow locking sleeve 18 to be pulled out from within outer and inner tubular bodies 12 and 14.

Figure 7:
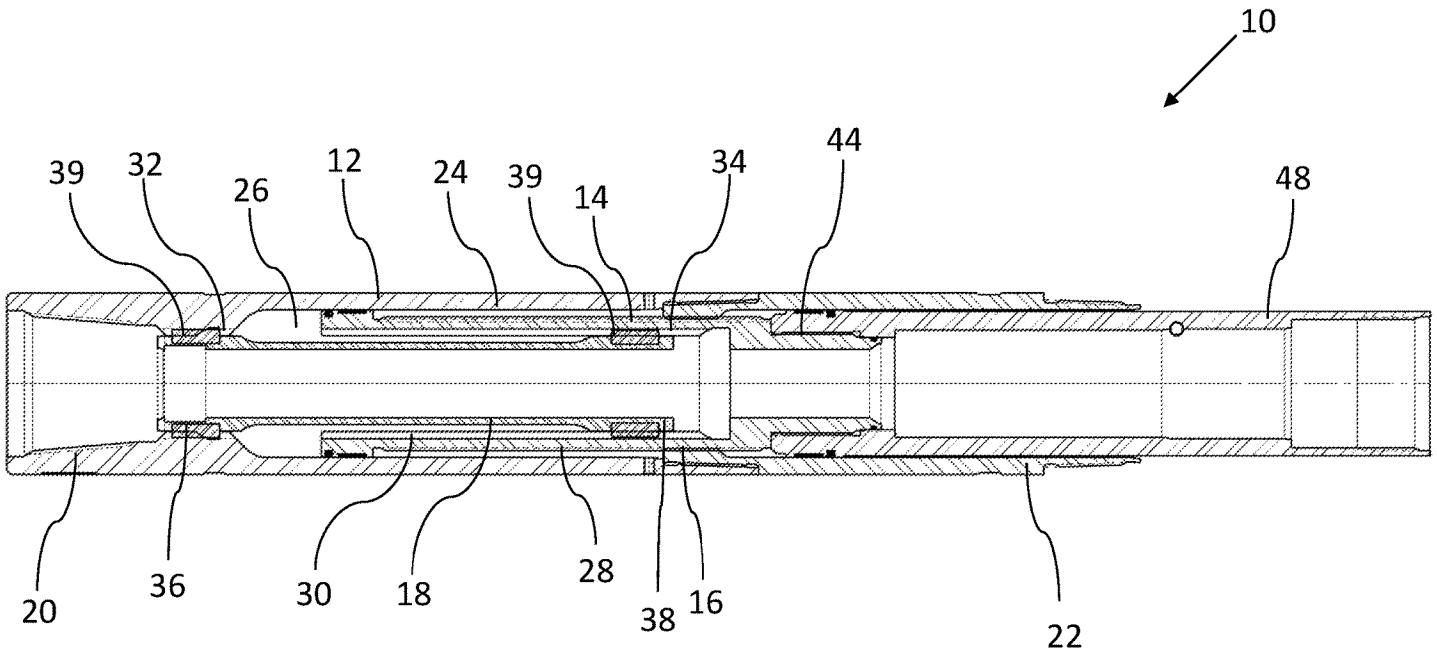
FIG. 7 is a side elevation cross-sectional view of an alternate embodiment of a length-adjustable connector for a downhole tool.

Using the structure described above, length-adjustable connector 10 may be used to adjust the position of a tool relative to outer tubular body 12, and thus to the tubing string to which outer tubular body 12 is attached. In particular, this is useful when installing a tool that is set within an outer tubing string, such as a core barrel for a coring tool. Inner tubular body 14 is provided with connection point 44 that can be connected to a desired tool. Connection point 44 extends axially away, or downstream as depicted, from locking sleeve 18 locking profile 34. As shown, outer tubular body 12 is formed from two parts, which allows the length to be changed by changing the second, or downstream, part in order to properly accommodate whatever is attached to connection point 44. As shown, in FIG. 1, FIG. 2, and FIG. 3, an attachment 48 is shown in the form of a tubular body that is attached to connection point 44 such that it retracts within outer tubular body 12 in the retracted position, and extends out from outer tubular body 12 in the extended position. Referring to FIG. 7, a different attachment 48 is shown, which may allow for a float valve (not shown) that is commonly used in coring tools to be installed. Other attachments and other tools may be attached to attachment point 48 as will be recognized by those skilled in the art.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A length-adjustable connector for a downhole tool, comprising:

an outer tubular body having a first end, a second end, an inner surface that defines an inner bore, and a first locking profile accessible from the inner bore;

an inner tubular body rotatably disposed within the inner bore of the outer tubular body, the inner tubular body comprising an outer surface and an inner surface, the inner surface comprising a second locking profile;

a threaded connection between the inner surface of the outer tubular body and the outer surface of the inner tubular body, the threaded connection causing axial movement of the inner tubular body relative to the outer tubular body as the inner tubular body rotates relative to the outer tubular body;

a locking sleeve having a first end that is sized to removably engage the first locking profile and a second end that is sized to removably engage the second locking profile, and the locking sleeve preventing relative rotation of the outer tubular body and the inner tubular body when engaged with the first and second locking profiles, wherein:

the locking sleeve comprises one or more axially-extending slots that engage one or more first locking keys that extend outward from the first end of the locking sleeve;

the first locking profile comprises one or more axially-extending slots and the one or more first locking keys simultaneously engage the axially-extending slots of each of the first locking profile and the locking sleeve; and a connector carried by the inner tubular body that extends axially away from the locking sleeve, the connector moving axially relative to the outer tubular body as the inner tubular body is rotated relative to the outer tubular body.

2. The length-adjustable connector of claim 1, wherein the outer tubular body comprises threaded connections for connecting to a downhole drill string.

3. The length-adjustable connector of claim 1, wherein the locking sleeve comprises one or more second locking keys spaced that engage the second locking profile of the inner tubular body.

4. The length-adjustable connector of claim 3, wherein the second locking profile comprises an axially extending slot in the inner surface of the inner tubular body.

5. The length-adjustable connector of claim 1, wherein the inner tubular body moves between a retracted position and an extended position relative to the outer tubular body as the inner tubular body is rotated relative to the outer tubular body.

6. The length-adjustable connector of claim 5, wherein the connector is sized to be received within the inner bore of the outer tubular body in at least the retracted position.

* * * * *